US007867344B2

(12) United States Patent
Kusumi et al.

(10) Patent No.: US 7,867,344 B2
(45) Date of Patent: Jan. 11, 2011

(54) HOT PRESSING METHOD FOR HIGH STRENGTH MEMBER USING STEEL SHEET AND HOT PRESSED PARTS

(75) Inventors: Kazuhisa Kusumi, Kitakyushu (JP); Jun Maki, Kitakyushu (JP); Masayuki Abe, Kitakyushu (JP); Masahiro Ohgami, Kitakyushu (JP); Norihiro Fujita, Tokai (JP); Shinya Nakajima, Kitakyushu (JP)

(73) Assignee: Nippon Steel Corporation, Chiyoda-ku, Tokyo (JP)

( * ) Notice: Subject to any disclaimer, the term of this patent is extended or adjusted under 35 U.S.C. 154(b) by 275 days.

(21) Appl. No.: 11/572,020

(22) PCT Filed: Jul. 15, 2005

(86) PCT No.: PCT/JP2005/013518

§ 371 (c)(1),
(2), (4) Date: Jan. 12, 2007

(87) PCT Pub. No.: WO2006/006742

PCT Pub. Date: Jan. 19, 2006

(65) Prior Publication Data

US 2007/0163685 A1 Jul. 19, 2007

(30) Foreign Application Priority Data

Jul. 15, 2004 (JP) ..... 2004-208326
Jul. 13, 2005 (JP) ..... 2005-203748

(51) Int. Cl.
*C21D 8/02* (2006.01)
*B32B 15/18* (2006.01)

(52) U.S. Cl. ..... 148/535; 148/534; 148/537; 148/531; 148/533; 148/635; 428/653; 428/659

(58) Field of Classification Search ..... 148/635, 148/633, 628, 582, 591, 606, 625, 531, 533, 148/535, 537, 634; 428/653, 469
See application file for complete search history.

(56) References Cited

U.S. PATENT DOCUMENTS 3,386,863 A * 6/1968 Rowe ..... 148/635
7,074,497 B2 * 7/2006 Suzuki et al. ..... 428/659

FOREIGN PATENT DOCUMENTS

EP 0522501 * 1/1993

(Continued)

OTHER PUBLICATIONS

Machine-English translation of Japanese patent 2003-181549, Maki Jun et al., Jul. 2, 2003.*

(Continued)

*Primary Examiner*—Deborah Yee
(74) *Attorney, Agent, or Firm*—Dorsey & Whitney LLP

(57) ABSTRACT

A method is proved for hot pressing hot rolled steel sheet, cold rolled steel sheet, Al-based plated steel sheet or Zn-based plated steel sheet, where the hot pressed sheet can exhibit a strength of at least about 1200 Mpa, and my be prevented from exhibiting hydrogen embrittlement. The steel sheet may include between about 0.05 to 0.5 wt % C, and/or it may be plated with an Al-based or Zn-based plating material. The steel sheet may be heating to a temperature greater than an $Ac_3$ temperature and not more than about 1100° C. before pressing. An atmosphere can be provided during heating which contains not more than about 6 vol % of hydrogen and a dew point of not more than about 10° C. The exemplary methods may be used to form high strength parts which may be used, e.g., in automobiles.

4 Claims, 1 Drawing Sheet

FOREIGN PATENT DOCUMENTS

| | | | | |
|---|---|---|---|---|
| EP | 1041167 | A1 | | 10/2000 |
| EP | 1143029 | | | 10/2001 |
| GB | 1233847 | | | 6/1971 |
| GB | 1532641 | A | | 11/2008 |
| JP | 358000315 | | * | 1/1983 |
| JP | 11-333530 | | | 12/1999 |
| JP | 2000-54161 | | | 2/2000 |
| JP | 2002282951 | | | 10/2002 |
| JP | 2002339054 | | | 11/2002 |
| JP | 2003-073774 | | * | 3/2003 |
| JP | 2003138343 | | | 5/2003 |
| JP | 2003181549 | | | 7/2003 |
| JP | 2004124221 | | | 4/2004 |
| WO | WO97/40196 | | | 10/1997 |

PUBLICATIONS

Machine-English translation of Japanese patent 2003-073774, Imai Kazuhito et al., Mar. 12, 2003.*

English language European Search Report for European Application No. EP 05 76 6503 dated Jun. 18, 2008.

English language European Official Communication dated Jun. 24, 2009 for European No. 05766503.6.

Corresponding Chinese Office Action dated Nov. 9, 2007 for application No. 200580023694X.

European Official Communication dated Oct. 26, 2010 for European application No. 05766503.6.

* cited by examiner (a)

(b)

HOT PRESSING METHOD FOR HIGH STRENGTH MEMBER USING STEEL SHEET AND HOT PRESSED PARTS

CROSS-REFERENCE TO RELATED APPLICATION(S)

This application is a national stage application of PCT Application No. PCT/JP2005/013518 which was filed on Jul. 15, 2005 and published on Jan. 19, 2006 as International Publication No. WO 2006/006742, the entire disclosure of which is incorporated herein by reference. This application claims priority from the International Application pursuant to 35 U.S.C. §365. The present application also claims priority under 35 U.S.C. §119 from Japanese Patent Application Nos. 2004-208326 and 2005-203748, filed Jul. 15, 2004 and Jul. 13, 2005, respectively.

FIELD OF THE INVENTION

The present invention relates to a method of hot pressing comprising using cold-rolled or hot-rolled steel sheet or Al-based or Zn-based plated steel sheet to hot press automobile pillars, door impact beams, bumper beams, or other strength parts and similar hot pressed parts.

BACKGROUND INFORMATION

To lighten the weight of automobiles, an issue arising from the problem of global warming, it may be preferable to make steel sheet used for automobiles that is very high in strength. When making a high-strength steel sheet, elongation and r values may decrease and formability may be reduced. To solve this problem, techniques for hot forming materials and using heat to increase strength are described, e.g., in Japanese Patent Publication (A) No. 2000-234153. This publication describes a technique which includes controlling a steel composition, heating the steel in a ferrite temperature region, and utilizing precipitation strengthening in this temperature region to increase the strength.

Japanese Patent Publication (A) No. 2000-87183 describes a high-strength steel sheet which can provide improved precision for press forming by reducing the yield strength at a formation temperature to a lower value than the yield strength at ordinary temperatures. However, the strength that can be obtained using such techniques may be limited. Alternatively, Japanese Patent Publication (A) No. 2000-38640 describes a technique for obtaining a higher strength by heating a material to a high-temperature austenite single-phase region after formation, and transforming it to a hard phase in a subsequent cooling process.

Heating and rapidly cooling a sheet after it is formed can decrease precision of the formed shape. To avoid this problem, techniques for heating steel sheet to an austenite single-phase region, then cooling the sheet in a press formation procedure using a cooling rate of at least the critical cooling rate of martensite transformation, as determined by the steel compositions, are described, e.g., in Cornette et al., "High Strength Steels for Automotive Safety Parts," (Paper No. SAE, 2001-01-0078, SAE World Congress, 2001) and in Japanese Patent Publication (A) No. 2001-181833. The Cornette publication describes a technique which can provide suppression of scaling of the surface at a time of heating by using Al-plated steel sheet. This type of pressing procedure can be referred to as "hot pressing."

Japanese Patent Publication (A) No. 2003-147499 describes a technique for using steel sheet covered by a plating layer that includes an Fe—Zn alloy for hot pressing, while Japanese Patent Publication (A) No. 2003-41343 describes a technique for using Al-based plated steel sheet covered by a plating layer that includes an Fe—Al alloy for hot pressing. Also, Japanese Patent Publication (A) No. 2002-282951 describes an exemplary technique using a die and punch to press a heated metal sheet, where the die clearance can be determined based on formability and hardenability considerations.

Thus, high strength steel sheet which may be used for automobiles, etc., may exhibit problems with respect to low formability and/or hydrogen embrittlement (which may be referred to as aging cracks or delayed fracture), particularly in high-strength materials of over 1000 MPa. Therefore, there may be a need for improved steel sheet which may be used for hot pressing, and it may further be desirable to decrease the amount of hydrogen in the material.

SUMMARY OF EXEMPLARY EMBODIMENTS OF THE INVENTION

Exemplary embodiments of the present invention can provide a method of hot pressing which can use hot rolled or cold rolled steel sheet, an Al-based plated steel sheet or a Zn-based plated steel sheet. A strength of about 1200 MPa or more may be achieved after high-temperature forming, and there may be only a small risk of hydrogen embrittlement in such pressed parts.

Controlling the atmosphere and temperature when heating to the austenite single-phase region before pressing can be important for producing hot pressed parts having improved resistance to hydrogen embrittlement. For example, hydrogen which may be present in an atmosphere at the time of heating can invade a steel sheet. If moisture is present, hydrogen may also invade the steel sheet. Thus it can be important to reduce a presence of both hydrogen and moisture. Further, a suitable selection of die clearance can also help to prevent hydrogen embrittlement.

Exemplary embodiments of the present invention can provide, for example, a method of hot pressing high-strength parts using steel sheet containing about 0.05 to 0.5 wt % C. Alternatively, steel sheet may be used that can be plated using plating baths that include primarily Al or Zn. A high-strength part such as, e.g., an automobile component, can be hot pressed where the temperature before pressing can be greater than the $Ac_3$ temperature, e.g., the temperature at which transformation of ferrite to austenite can be essentially completed, and may be not more than about 1100° C. A hydrogen concentration in the heating atmosphere can be not more than about 6 vol %, and a dew point of the atmosphere can be not more than about 10° C. In further exemplary embodiments of the present invention, the hydrogen concentration in the heating atmosphere can be not more than about 1 vol %.

The steel sheet can be provided to a press machine after heating, and a clearance between a die and punch at the time of forming can be selected to be between about 1.0 and 1.8 times the thickness of the steel sheet material used.

Still further exemplary embodiments of the present invention can provide hot pressed parts formed using the techniques described herein.

These and other objects, features and advantages of the present invention will become apparent upon reading the following detailed description of embodiments of the invention, when taken in conjunction with the appended claims.

BRIEF DESCRIPTION OF THE DRAWING

Further objects, features and advantages of the invention will become apparent from the following detailed description taken in conjunction with the accompanying figure showing illustrative embodiments, results and/or features of the exemplary embodiments of the present invention, in which.

DETAILED DESCRIPTION OF EXEMPLARY EMBODIMENTS OF INVENTION

Figure 1:
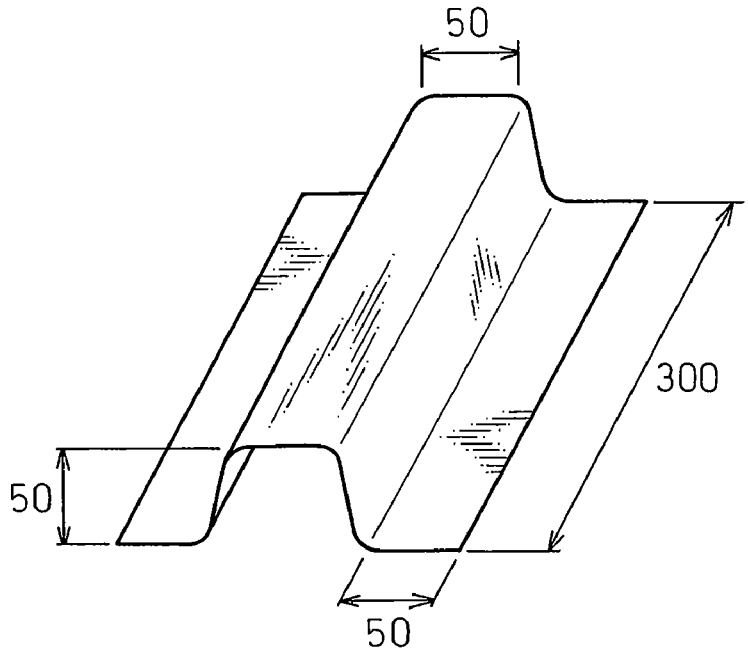
FIG. 1 is an external view of an exemplary hat-shaped die which may be used to perform a processing test.
Figure 1:
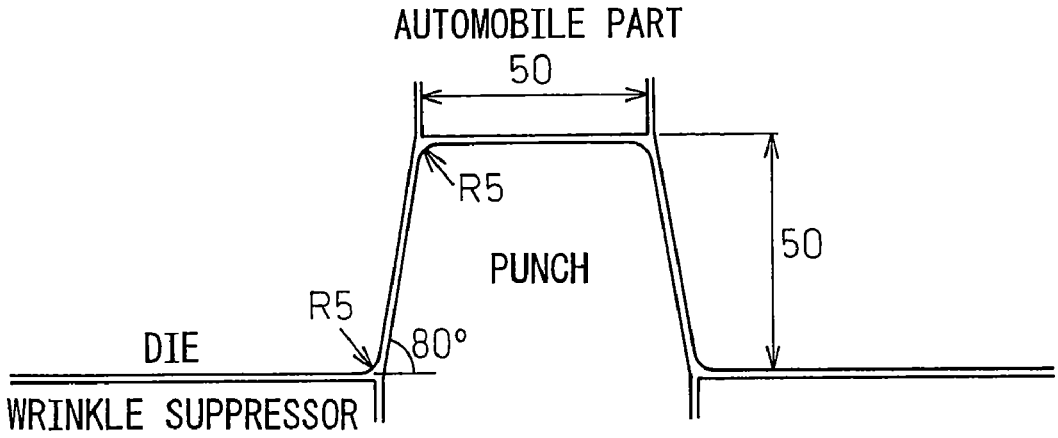

Exemplary embodiments of the present invention can provide a technique which includes, e.g., heating hot rolled or cold rolled steel sheet, or Al-based or Zn-based plated steel sheet to a temperature of about 700° C. or more, then hot forming it and immediately cooling and hardening it in a die to obtain a desired strength. Steel sheet compositions which may be used in accordance with exemplary embodiments of the present invention may have desirable hardenability properties. For example, the amount of C present in a sheet may be about 0.05% or more, or preferably 0.1% or more. Other elements which may be present in the steel can include, e.g., Si, Mn, Ti, B, Cr, Mo, Al, P, S, N, and so on. Si may have an effect on fatigue characteristics and can be provided in an amount, e.g., between about 0.05 and 1%. Mn, B, Cr, and/or Mo can contribute to improvement of the hardenability. For example, Mn, if present, can be provided in a range of about 0.5 to 3%, B, if present, can be provided in an amount of about 0.05% or less and Cr, if present, can be provided in an amount of about 2% or less. If Mo is present, it may be preferable to provide it in an amount of about 0.5% or less. Ti and Al can improve oxidation resistance of Al-based plated steel sheet. If Ti is present, it may be preferable to provide it in an amount of about 0.5% or less and Al, if present, can be provided in an amount of about 0.1% or less.

Steel sheet having an Al-based or Zn-based plating may be used in accordance with further exemplary embodiments of the present invention. Such plating may suppress formation of iron oxide at the surface and/or provide corrosion resistance when steel sheets are hot pressed.

Al-based plated steel sheets can be used for a variety of applications. In accordance with exemplary embodiments of the present invention, a steel sheet having an Al-based plating layer may be used, where the plating includes primarily Al. The plating can also include, e.g., about 3 to 15% of Si which can help to suppress formation of an alloy layer during a hot dip of the Al coating. In addition, other elements can be included which may further improve more corrosion resistance of the plating layer such as, e.g., Cr, Mg, Ti, Sn, and so on. These elements may be provided in the following amounts: Cr—about 0.1 to 1%; Mg—about 0.5 to 10%; Ti—about 0.1 to 1%; and Sn—about 1 to 5%. The Al-based plating layer may also contain Fe as an impurity in an amount between about 0.05 to 0.5%.

After heating of such a steel sheet, the surface region may include intermetallic compounds such as, e.g., $FeAl_3$, $Fe_2Al_5$, $Fe_3Al$, and/or $Fe_2Al_8Si$. These phases may have a form of composite layer structures which include five layers. The composition of the surface region can include primarily Al and Fe. Si may be provided in the Al plating bath in an amount of about 5 to 10%. These elements, e.g., Fe, Al and Si, can form at least about 90% of the total. Further, there may also be a small amount of residual Al which may not be alloyed, and such a small amount may not have a significant effect on the performance of the formed material. An Al-based oxide or nitride can cover apportion of the surface of such a sheet after it is heated, but the amount of these compounds may not be precisely specified. Such compounds may not have a significant effect on methods provided in accordance with exemplary embodiments of the preset invention.

In accordance with further exemplary embodiments of the present invention, a steel sheet having a Zn-based plated steel may be used. Compositions of Zn-based plating layers can include, e.g., Zn-0.2% Al, Zn-5% Al-0.1% Mg, Zn-5% Al-0.1% Mg-mische metal, Zn-7% Al-3% Mg, Zn-11% Al-3% Mg-0.1% Si, Zn-55% Al-1.6% Si, and so on, where the listed compositions may be approximate. In addition, a composition of Zn-10% Fe can be obtained, e.g., by plating a steel sheet in a Zn-0.1% Al bath and then heating the plated sheet. Further elements may also be added which can improve corrosion resistance of the plating layer such as, e.g., Cr, Mg, Ti, Sn, and so on. These elements may be provided in the following amounts: Cr—about 0.1 to 1%; Mg—about 0.5 to 10%; Ti—about 0.1 to 1%; and Sn—about 1 to 5%.

After heating such plates containing a Zn-based plating layer, the surface may include, e.g., ζ, δ1, Γ, Γ1 phases or other intermetallic compounds, and/or a ferrite phase containing Zn in solid solution. These phases, if present, may be distributed in layers or in a form of particles. Further, if the Zn-based plating material includes Al, formation of Fe—Al-based compounds such as those listed herein above may occur. A Zn-based or Al-based oxide film can be formed after heating of such a coated sheet, and such a film may not have a significant effect on methods provided in accordance with exemplary embodiments of the preset invention.

Various amounts of Al-based or Zn-based plating may be deposited on a sheet, and various treatments can be applied before and/or after plating of a steel sheet in accordance with exemplary embodiments of the present invention. It may be preferable to provide a plating layer that is, e.g., at least about 50 $g/m^2$ on one side of the sheet. A larger amount of plating deposited can provide greater suppression of oxidation during heating and/or improved corrosion resistance of a component after it is heated and formed. Treatments for, e.g., primary rust prevention and lubrication can be provided such as, for example, a chromate treatment, resin coating, and so on. However, an organic resin may be consumed or decomposed upon heating, so such a treatment may not be preferable. Electrolytic chromate or other trivalent coatings may be preferably used for chromate treatments, as there may be been restrictions on using hexavalent chrome. An Al-based plated steel sheet may also be provided with an oil coating, rather than a chromate coating, which can also result in improved corrosion resistance.

Certain temperatures and properties of a heating atmosphere can be specified in accordance with exemplary embodiments of the present invention. For example, the heating temperature can be greater than at least about the $Ac_3$ temperature, and it may be not more than about 1100° C. Heating to a temperature greater than about the $Ac_3$ temperature can allow the steel sheet to completely transform to an austenite single-phase region. On the other hand, if the heating temperature is too high, the surface may oxidize and hydrogen can more actively invade the steel.

Furthermore, the boiling point of Zn is approximately 910° C. If a Zn-based plating is used, Zn may evaporate and the steel sheet can become significantly oxidized at a high temperature. Thus, a temperature of not more than about 1000° C. may be preferred, or more preferably not more than about 920° C. A lower temperature limit for heating the steel sheet can be about 800° C. If the sheet is heated to about the $Ac_3$ temperature or hotter, when the steel sheet is taken out from the furnace and transported to the press machine after heating, the temperature can drop and ferrite may be formed under some conditions.

The heating atmosphere can have a hydrogen concentration of about 6 vol % or less. This concentration may be preferable because, as described above, invasion of hydrogen into the steel can increase the likelihood of hydrogen embrittlement. Lower hydrogen concentrations may be preferable. For example, the concentration of hydrogen may be more preferably about 1% or less.

Moisture in the atmosphere may also invade the steel as hydrogen. Therefore, it may be preferable to have low moisture in the heating atmosphere. A dew point can be used to describe moisture content. An upper limit for the dew point in the heating atmosphere can be about 10° C. Using equation 1, provided below, a relationship can be described between a dew point and moisture content. For example, a moisture content corresponding to a dew point of about 10° C. can be about 1.2 vol %. When using a Zn-based plated steel sheet, providing a heating atmosphere which contains oxygen can cause a Zn oxide to form on the surface of the steel sheet, which can suppress evaporation of Zn. Therefore, when using a Zn-based plated steel sheet, the atmosphere may preferably contain oxygen in an amount of about 1 to 21%. Further, both plated and unplated steel sheet (e.g., bare material) can be invaded by hydrogen during heating, so the hydrogen concentration and moisture content of the heating atmosphere should be controlled.

An equation which can provide a relationship between hydrogen concentration and dew point in an atmosphere can be written as:

$$pH_2O = \exp\left(-\frac{44016 - 118.774 * Tdp}{8.314 * Tdp}\right), \quad (1)$$

where $pH_2O$ can represent hydrogen concentration (vol %), and Tdp can represent a dew point (in units of absolute temperature, e.g., in degrees Kelvin).

A variety of heating techniques may be used in accordance with exemplary embodiments of the present invention. For example, heating may be performed using, e.g., radiant heating by radiant tubes and so on, induction heating, conduction heating, etc. The heating rate may be selected based on the sheet thickness and the shape of the material being heated.

Hot pressing can be characterized by a cooling from an austenite phase to obtain a hardened microstructure. A cooling rate after heating can have a significant effect on the process. In accordance with exemplary embodiments of the present invention, the cooling rate may be greater than or equal to the critical cooling rate for obtaining a martensite structure based on the steel composition. For example, for cooling from 700° C. to 350° C., a cooling rate may preferably be about 15° C./sec or greater. The cooling rate may depend on the composition of the steel that is used. For example, in a steel having good hardenability characteristics, a desired structure which includes mostly martensite can be obtained using a cooling rate, e.g., of about 20° C./sec. Depending on the type of the steel used, a cooling rate of about 30° C./sec or greater may be preferable.

A clearance between a die and a punch can be an important factor when pressing a material. In accordance with exemplary embodiments of the present invention, this clearance may be preferably about 1.0 to 1.8 times the sheet thickness. If the clearance is smaller the sheet may have difficulty flowing, which can result in ironing. This can generate galling of the surface of the steel sheet, which may form a starting point for hydrogen embrittlement. Also, if the clearance between the die and punch is much larger, hardening may become difficult, the part can become uneven in strength, residual stress may remain in the part, and the possibility of hydrogen embrittlement can increase.

EXAMPLES

The examples provided herein below can be used to describe exemplary embodiments of the present invention in further detail.

Example 1

Cold rolled steel sheets having steel compositions shown in Table 1 and having a thickness of 1.4 mm were heated under various conditions, then formed by a hat-shaped die as shown in FIG. 1. The clearance between the die and the punch can be an important factor when pressing a material. In accordance with exemplary embodiments of the present invention, the clearance was selected to be about 1.1 times the sheet thickness. After forming, 5 mm holes were punched at 10 points in a flange of each part, each hole having a clearance of about 0.5 mm on two sides. After seven days, a 20× power loupe was used to examine the regions around the holes and detect the presence of any microcracks.

The samples were heated by inserting them into an electric furnace having a controlled atmosphere. The time for raising the temperature to about 900° C. was about 4 minutes, the time to transfer each sample from the furnace to the press was about 10 seconds, and the press start temperature was about 750° C. The cooling occurred primarily in the die. The average cooling rate from 700° C. to 350° C. was about 40° C./sec. A summary of the heating conditions and observation of any microcracks are shown in Table 2.

After forming the sheets in the hat-shaped die, portions of the formed sheets were cut out and measured for Vicker's hardness at a load of 10 kgf. The values observed for the Vicker's hardness (Hv) were in the range of about 410 to 510, and a martensite structure was observed in all sample portions. Also, after hot pressing, iron oxide was observed on the surface of these steel sheets.

Sample No. 8 described herein in Table 2 was heated in an atmosphere having a ly high dew point. Five or more microcracks were observed in this sample. Sample and 3 in Table 2 were heated in an atmosphere having more than about 1% hydrogen, me microcracks were observed in these samples.

TABLE 1

Composition (in wt %) of steels used in Example 1.

| Steel | C | Si | Mn | P | S | Al | N | Ti | Cr | Mo | B |
|---|---|---|---|---|---|---|---|---|---|---|---|
| A | 0.15 | 0.1 | 2.1 | 0.01 | 0.004 | 0.03 | 0.004 | 0.02 | 0.4 | 0.01 | 0.003 |
| B | 0.21 | 0.2 | 0.9 | 0.02 | 0.005 | 0.015 | 0.005 | 0.01 | 0.9 | 0.4 | 0.004 |
| C | 0.27 | 0.15 | 0.88 | 0.01 | 0.002 | 0.02 | 0.004 | 0.02 | 0.23 | 0.5 | 0.003 |

TABLE 2

Process conditions and microcrack observations for formed steels described in Example 1.

| | | | | Heating atmosphere | | | | |
|---|---|---|---|---|---|---|---|---|
| No. | Steel | Temp. (° C.) | Holding temp. (min) | Hydrogen (vol %) | Dew point (° C.) | Oxygen (vol %) | Occurrence of microcracks | |
| 1 | A | 950 | 1 | 5 | 8 | 0.01 | F | Comp. ex. |
| 2 | A | 900 | 1 | 0.1 | 2 | 0.3 | VG | Inv. ex. |
| 3 | B | 800 | 2 | 2 | −10 | 0.5 | G | Inv. ex. |
| 4 | B | 850 | 3 | 0.5 | 0 | 21 | VG | Inv. ex. |
| 5 | C | 1000 | 1 | 0.1 | −30 | 21 | VG | Inv. ex. |
| 6 | C | 850 | 5 | 0.05 | 2 | 21 | VG | Inv. ex. |
| 7 | A | 900 | 10 | 0.07 | 6 | 21 | VG | Inv. ex. |
| 8 | B | 850 | 8 | 0.1 | 13 | 21 | P | Comp. ex. |
| 9 | B | 850 | 5 | 0.2 | 0 | 21 | VG | Inv. ex. |
| 10 | C | 850 | 2 | 0.1 | −10 | 21 | VG | Inv. ex. |

Note:
Occurrence of microcracks ratings are based on the total number of microcracks observed at 10 points as follows:
VG (very good)-0;
G (good): 1;
F (fair)-less than 5;
P (poor)-5 or more.

Example 2

Cold rolled steel sheets having steel compositions provided in Table 3 after conventional hot rolling and cold rolling processes, and having sheet thickness of about 1.4 mm, were used as materials for hot dip Al coating. The hot dip Al coating was performed using a nonoxidizing furnace-reduction furnace type line. After plating, a gas wiping method was used to adjust the plating deposition to 80 g/m$^2$ per side. The sheets were then cooled. The plating appearance was good, with no visible unplated areas. The plating material composition was Al-10% Si-2% Fe, and a bath temperature of about 660° C. was used. These values are also provided in Table 9. The Fe present in the bath was essentially an impurity which originated from the plating equipment and/or steel strip.

The hot dip Al coated steel sheets were heated under various conditions, then formed by the hat-shaped die shown in FIG. 1. The clearance was selected to be about 1.1 times the sheet thickness. After forming, 5 mm holes were punched at 10 points in a flange of each part, each hole having a clearance of about 0.5 mm on two sides. After seven days, a 20× power loupe was used to examine the regions around the holes and detect the presence of any microcracks.

The samples were heated by inserting them into an electric furnace having a controlled atmosphere. The time for raising the temperature to about 900° C. was about 4 minutes, the time to transfer each sample from the furnace to the press was about 10 seconds, and the initial press temperature was about 750° C. Cooling of the samples occurred primarily in the die. The average cooling rate from 700° C. to 350° C. was about 40° C./sec. A summary of the process conditions and observation of any microcracks are shown in Table 4.

After forming the sheets in the hat-shaped die, portions of the formed sheets were cut out and measured for Vicker's hardness at a load of 10 kgf. The values observed for the Vicker's hardness (Hv) were in the range of about 410 to 510, and a martensite structure was observed in all sample portions. Also, after hot pressing, iron oxide was not observed on the surfaces of these steel sheets.

The information provided in Table 4 may suggest that the heating atmosphere and temperature can affect the amount of hydrogen invading the steel and the propensity to form microcracks. For example, sample No. 5 which was heated in an atmosphere having a hydrogen concentration of about 10 vol %, and sample No. 8 which was heated in an atmosphere having a dew point of about 15° C., each was observed to have five or more microcracks. As the hydrogen concentration and dew point are lowered, the formation of cracks may be suppressed, although sample of Nos. 6, 11, and 16 in Table 4 were observed to have some microcracks.

TABLE 3

| Composition (in wt %) of steel used in Example 2. | | | | | | | | | | |
|---|---|---|---|---|---|---|---|---|---|---|
| C | Si | Mn | P | S | Al | N | Ti | Cr | Mo | B |
| 0.22 | 0.21 | 1.20 | 0.02 | 0.003 | 0.027 | 0.003 | 0.002 | 0.18 | 0.02 | 0.0018 |

TABLE 4

| Process conditions and microcrack observations for formed steels described in Example 2. | | | | | | | |
|---|---|---|---|---|---|---|---|
| | | Holding | Heating atmosphere | | | Occurrence of | |
| No. | Temp. (° C.) | temp. (min) | Hydrogen (vol %) | Dew point (° C.) | Oxygen (vol %) | micro-cracks | |
| 1 | 800 | 5 | 0.01 | 2 | 0.3 | VG | Inv. ex. |
| 2 | 900 | 3 | 0.02 | 1 | 0.5 | VG | Inv. ex. |
| 3 | 1000 | 2 | 0.1 | 3 | 0.8 | VG | Inv. ex. |
| 4 | 1100 | 2 | N.D. | 1 | 1 | VG | Inv. ex. |
| 5 | 900 | 2 | 10 | 0 | 0.01 | P | Comp. ex. |
| 6 | 900 | 2 | 4 | 1 | 0.01 | F | Inv. ex. |
| 7 | 900 | 2 | 1 | −1 | 0.01 | VG | Inv. ex. |
| 8 | 900 | 2 | 0.1 | 15 | 0.01 | P | Comp. ex. |
| 9 | 900 | 2 | 0.1 | 6 | 0.1 | VG | Inv. ex. |
| 10 | 900 | 2 | 0.05 | 2 | 0.1 | VG | Inv. ex. |
| 11 | 900 | 2 | 2 | −20 | 0.5 | G | Inv. ex. |
| 12 | 900 | 2 | 0.01 | 7 | 21 | VG | Inv. ex. |

TABLE 4-continued

| Process conditions and microcrack observations for formed steels described in Example 2. | | | | | | | |
|---|---|---|---|---|---|---|---|
| | | Holding | Heating atmosphere | | | Occurrence of | |
| No. | Temp. (° C.) | temp. (min) | Hydrogen (vol %) | Dew point (° C.) | Oxygen (vol %) | micro-cracks | |
| 13 | 900 | 2 | 0.01 | 1 | 21 | VG | Inv. ex. |
| 14 | 980 | 8 | 0.01 | 1 | 21 | VG | Inv. ex. |
| 15 | 1050 | 5 | 0.01 | 1 | 21 | VG | Inv. ex. |
| 16 | 900 | 10 | 5 | 6 | 0.06 | F | Comp. ex. |

Note:

Occurrence of microcracks ratings are based on the total number of microcracks observed at 10 points as follows:

VG (very good)-0;

G (good): 1;

F (fair)-less than 5;

P (poor)-5 or more.

Example 3

Cold rolled steel sheets having steel compositions provided in Table 5 and thicknesses of about 1.4 mm were plated with Zn-based plating materials. The plating composition, deposition quantity and bath temperature are provided in Table 6. These Zn-based plated steel sheets were formed in an exemplary hat-shaped die press as described in Example 1. The samples were examined to determine the presence of any microcracks after forming. Process conditions and observations of micro-cracks for several samples are provided in Table 7.

The cooling of each formed sample occurred primarily in the die. The average cooling rate from 700° C. to 350° C. was about 20° C./sec. These samples were measured for cross-sectional hardness after formation as described in Example 1. The hardness value, Hv, of each sample was observed to be in the range of about 410 to 510, and the observed structures were martensitic microstructures. After hot pressing, iron oxide was not observed on the surface of these steel sheets.

TABLE 5

| Composition (in wt %) of steels used in Example 3. | | | | | | | | | | | |
|---|---|---|---|---|---|---|---|---|---|---|---|
| Symbol | C | Si | Mn | P | S | Al | N | Ti | Cr | Mo | B |
| A | 0.15 | 0.1 | 2.1 | 0.01 | 0.004 | 0.03 | 0.004 | 0.02 | 0.4 | 0.01 | 0.003 |
| B | 0.21 | 0.2 | 0.9 | 0.02 | 0.005 | 0.015 | 0.005 | 0.01 | 0.9 | 0.4 | 0.004 |
| C | 0.27 | 0.15 | 0.88 | 0.01 | 0.002 | 0.02 | 0.004 | 0.02 | 0.23 | 0.5 | 0.003 |

TABLE 6

| Composition (in wt %) of Zn-based plating materials used in Example 3. | | | |
|---|---|---|---|
| Symbol | Composition of plating layer | Single side deposition ($g/m^2$) | Bath temp. (° C.) |
| GI | Zn—0.2%Al | 85 | 460 |
| GA | Zn—10.5%Fe | 70 | 460 |
| GL | Zn—55%Al—1.6%Si | 75 | 610 |
| GAM | Zn—6%Al—3%Mg | 65 | 420 |
| GAMS | Zn—11%Al—3%Mg—0.1%Si | 80 | 430 |

TABLE 7

Process conditions and microcrack observations for formed steels with Zn-based plating described in Example 3.

| No. | Steel | Plating | Temp. (° C.) | Holding time (min) | Heating atmosphere Hydrogen (vol %) | Dew point (° C.) | Oxygen (vol %) | Occurrence of micro-cracks | |
|---|---|---|---|---|---|---|---|---|---|
| 1 | A | GI | 950 | 1 | 5 | 8 | 0.01 | F | Comp. ex. |
| 2 | A | GA | 900 | 1 | 0.1 | 2 | 0.3 | VG | Comp. ex. |
| 3 | B | GL | 800 | 2 | 2 | −10 | 0.5 | G | Comp. ex. |
| 4 | B | GAM | 850 | 3 | 0.5 | 0 | 21 | VG | Inv. ex. |
| 5 | C | GAMS | 1000 | 1 | 0.1 | −30 | 21 | VG | Inv. ex. |
| 6 | C | GI | 850 | 5 | 0.05 | 2 | 21 | VG | Inv. ex. |
| 7 | A | GI | 900 | 10 | 0.07 | 6 | 21 | VG | Inv. ex. |
| 8 | B | GA | 850 | 8 | 0.1 | 13 | 21 | P | Comp. ex. |
| 9 | B | GA | 850 | 5 | 0.2 | 0 | 21 | VG | Inv. ex. |
| 10 | C | GL | 850 | 2 | 0.1 | −10 | 21 | VG | Inv. ex. |

Note:

Occurrence of microcracks ratings are based on the total number of microcracks observed at 10 points as follows:

VG (very good)-0;

G (good): 1;

F (fair)-less than 5;

P (poor)-5 or more.

Sample No. 8 described in Table 7 was heated in an atmosphere having a high dew point and microcracks were observed. Sample Nos. 1 and 3 were heated in an atmosphere having more than about 1% hydrogen, and some microcracks were observed in these samples. These observations are consistent with those described in Examples 1 and 2. Also, sample Nos. 1-3 were heated in an atmosphere having a low oxygen concentration. Zn coating these samples was observed to evaporate in the furnace and contaminate it, and deterioration of the surfaces of these steel sheets was observed.

Example 4

Cold rolled steel sheets having compositions provided in Table 8 after conventional hot rolling and cold rolling processes, and having a sheet thickness of about 1.4 mm, were used as samples. These sheets were coated with Al by hot dipping or coated with Zn by hot dipping. The hot dipping was performed using a nonoxidizing furnace-reduction furnace type line. After plating, a gas wiping method was used to adjust the plating deposition. The coated sheets were then cooled. The plating appearance was good, with no unplated areas observed. The plating material compositions and bath temperatures are provided in Table 9.

TABLE 8

Composition (in wt %) of steel used in Example 4.

| C | Si | Mn | P | S | Al | N | Ti | Cr | Mo | B |
|---|---|---|---|---|---|---|---|---|---|---|
| 0.22 | 0.21 | 1.20 | 0.02 | 0.003 | 0.027 | 0.003 | 0.002 | 0.18 | 0.02 | 0.0018 |

TABLE 9

Composition (in wt %) of plating materials used in Example 4.

| Symbol | Composition of plating layer | Single side deposition ($g/m^2$) | Bath temp. (° C.) |
|---|---|---|---|
| AL | Al—10%Si—2% Fe | 80 | 660 |
| GI | Zn—0.2%Al | 85 | 460 |
| GA | Zn—10.5%Fe | 70 | 460 |

These steel sheets were heated under various conditions and then formed using the exemplary hat-shaped die shown in FIG. 1. The clearance between the die and the punch at the time of hot pressing is shown in Table 10. After hot pressing, 5 mm holes were punched at 10 points in a flange of each part, each hole having a clearance of about 0.5 mm on two sides. After seven days, a 20× power loupe was used to examine the regions around the holes and detect the presence of any microcracks.

The samples were heated by inserting them into an electric furnace having a controlled atmosphere. The time for raising the temperature to about 900° C. was about 4 minutes, the time to transfer each sample from the furnace to the press was about 10 seconds, and the initial press temperature was about 750° C. Cooling of the samples occurred primarily in the die. The average cooling rate from 700° C. to 350° C. was about 40° C./sec. The heating conditions and observation of any microcracks are provided in Table 10.

These samples were measured for cross-sectional hardness after formation as described in Example 1. The hardness value, Hv, of each sample was observed to be in the range of about 410 to 510, and the observed structures were martensitic microstructures.

TABLE 10

Process conditions and microcrack observations for formed steels described in Example 4.

| No. | Clearance at hot press (thickness ratio) | Type of plating | Temp. (° C.) | Holding time (min) | Heating atmosphere Hydrogen (vol %) | Dew point (° C.) | Oxygen (vol %) | Occurrence of microcracks | Production of iron oxide | |
|---|---|---|---|---|---|---|---|---|---|---|
| 1 | 0.8 | CR | 900 | 3 | 0.02 | 1 | 0.5 | P | Yes | Comp. ex. |
| 2 | 1.0 | CR | 900 | 3 | 0.02 | 1 | 0.5 | VG | Yes | Inv. ex. |
| 3 | 1.1 | CR | 900 | 3 | 0.02 | 1 | 0.5 | VG | Yes | Inv. ex. |
| 4 | 1.4 | CR | 900 | 3 | 0.02 | 1 | 0.5 | VG | Yes | Inv. ex. |
| 5 | 1.7 | CR | 900 | 3 | 0.02 | 1 | 0.5 | G | Yes | Inv. ex. |
| 6 | 1.9 | CR | 900 | 3 | 0.02 | 1 | 0.5 | P | Yes | Comp. ex. |
| 7 | 0.8 | GI | 900 | 10 | 0.07 | 6 | 21 | P | No | Comp. ex. |
| 8 | 1.0 | GI | 900 | 10 | 0.07 | 6 | 21 | VG | No | Inv. ex. |
| 9 | 1.1 | GI | 900 | 10 | 0.07 | 6 | 21 | VG | No | Inv. ex. |
| 10 | 1.4 | GI | 900 | 10 | 0.07 | 6 | 21 | VG | No | Inv. ex. |
| 11 | 1.7 | GI | 900 | 10 | 0.07 | 6 | 21 | G | No | Inv. ex. |
| 12 | 1.9 | GI | 900 | 10 | 0.07 | 6 | 21 | P | No | Comp. ex. |
| 13 | 0.8 | GA | 850 | 5 | 0.2 | 0 | 21 | P | No | Comp. ex. |
| 14 | 1.0 | GA | 850 | 5 | 0.2 | 0 | 21 | VG | No | Inv. ex. |
| 15 | 1.1 | GA | 850 | 5 | 0.2 | 0 | 21 | VG | No | Inv. ex. |
| 16 | 1.4 | GA | 850 | 5 | 0.2 | 0 | 21 | VG | No | Inv. ex. |
| 17 | 1.7 | GA | 850 | 5 | 0.2 | 0 | 21 | G | No | Inv. ex. |
| 18 | 1.9 | GA | 850 | 5 | 0.2 | 0 | 21 | P | No | Comp. ex. |

Note:
Occurrence of microcracks ratings are based on the total number of microcracks observed at 10 points as follows:
VG (very good)-0;
G (good): 1;
F (fair)-less than 5;
P (poor)-5 or more.

Sample Nos. 1, 7 and 13 described in Table 10 had clearances between the die and punch at the time of hot pressing of less than the sheet thickness (e.g., the ratio is less than 1). Five or more microcracks were observed in these samples. Sample Nos. 6, 12 and 18 described in Table 10 had die clearances at the time of hot pressing which were greater than about 1.8 times the sheet thickness. The samples exhibited nonuniform strength and residual stress, and five or more microcracks were observed in each of them. Sample Nos. 5, 11 and 17 had somewhat larger die clearances at the time of hot pressing, (e.g., a clearance of about 1.7 times the sheet thickness). Such samples also exhibited nonuniform strength and residual stress remaining in the parts, as well as some microcracks.

INDUSTRIAL APPLICABILITY

In accordance with exemplary embodiments of the present invention, hot rolled or cold rolled steel sheet or Al-based plated steel sheet or Zn-based plated steel sheet may be used to produce high strength members using a hot pressing technique. Such members can also be produced which do not exhibit hydrogen embrittlement.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. In addition, all publications referenced above are incorporated herein by reference in their entireties.

The invention claimed is:

1. A method for hot pressing a high-strength automobile part to prevent hydrogen embrittlement, the method comprising:

providing a steel sheet comprising a plating layer that is at least about 50 g/m$^2$ on one side of the steel sheet, and containing between about 0.05 and 0.5 wt % C;

heating the steel sheet to a temperature between about an $Ac_3$ temperature and about 1100° C. in an atmosphere;

controlling a hydrogen concentration of the atmosphere to be not more than about 0.5 vol %, a dew point of the atmosphere to be not more than about 10° C., and an oxygen concentration of the atmosphere to be between about 0.3 and 21 vol %; and hot pressing the steel sheet after the steel sheet is heated, wherein the steel sheet is hot pressed by:

(i) introducing the steel sheet into a press machine, and (ii) providing a clearance between a die and a punch during the hot pressing procedure that is between about 1.0 and about 1.8 times of the thickness of the steel sheet.

2. A method for hot pressing a high-strength automobile part to prevent hydrogen embrittlement, the method comprising:

providing a steel sheet comprising a plating layer that is at least about 50 $g/m^2$ on one side of the steel sheet, and containing between about 0.05 to 0.5 wt % C, having mainly an Al plating;

heating the steel sheet to a temperature between about an $Ac_3$ temperature and about 1100° C. in an atmosphere;

controlling a hydrogen concentration of the atmosphere to be not more than about 0.5 vol %, a dew point of the atmosphere to be not more than about 10° C., and an oxygen concentration of the atmosphere to be between about 0.3 and 21 vol %; and hot pressing the steel sheet after the steel sheet is heated.

3. A method for hot pressing a high-strength automobile part to prevent hydrogen embrittlement, the method comprising:

providing a steel sheet comprising a plating layer that is at least about 50 $g/m^2$ on one side of the steel sheet, and containing between about 0.05 to 0.5 wt % C, having mainly a Zn plating;

heating the steel sheet to a temperature between about an $Ac_3$ temperature and about 1100° C. in an atmosphere;

controlling a hydrogen concentration of the atmosphere to be not more than about 0.5 vol %, a dew point of the atmosphere to be not more than about 10° C., and an oxygen concentration of the atmosphere to be between about 0.3 and 21 vol %; and hot pressing the steel sheet after the steel sheet is heated.

4. A hot pressed automobile member produced by a method according to any one of claims 1, 2 and 3.

* * * * *